United States Patent [19]

Haberstroh

[11] Patent Number: 4,880,021

[45] Date of Patent: Nov. 14, 1989

[54] DEVICE FOR CLEANING CANS

[76] Inventor: Karl Haberstroh, Hohenkrahenstr. 2, D-7703 Rielasingen-Worblingen, Fed. Rep. of Germany

[21] Appl. No.: 148,659

[22] Filed: Jan. 5, 1988

[30] Foreign Application Priority Data

May 7, 1986 [DE] Fed. Rep. of Germany ..... 3615538
Aug. 1, 1986 [DE] Fed. Rep. of Germany ..... 3626176

[51] Int. Cl.[4] ..... B08B 3/02

[52] U.S. Cl. ..... 134/62; 134/125; 134/131

[58] Field of Search ..... 134/60, 62, 63, 66, 134/69, 73, 124, 125, 126, 131, 133, 43; 198/375, 377, 379, 402, 405, 411, 373, 404

[56] References Cited

U.S. PATENT DOCUMENTS

| | | | |
|---|---|---|---|
| 1,185,329 | 5/1916 | Janisca | 134/126 X |
| 1,411,288 | 4/1922 | McGowan | 134/62 X |
| 2,708,943 | 5/1955 | Watson et al. | 134/62 |
| 3,092,125 | 6/1963 | Kinsey | 134/131 X |
| 3,353,515 | 11/1967 | Stollel et al. | 134/170 X |
| 3,595,251 | 7/1971 | Tarantola | 198/402 X |
| 3,675,665 | 3/1972 | Sadwith | 134/62 X |
| 3,915,285 | 10/1975 | Lindquist | 134/131 X |
| 4,080,974 | 3/1978 | Oag | 134/62 |
| 4,324,265 | 4/1982 | Fautn | 134/198 X |
| 4,333,485 | 6/1982 | Karlsson | 134/60 |
| 4,423,745 | 1/1984 | Butt et al. | 134/62 |

*Primary Examiner*—Frankie L. Stinson
*Attorney, Agent, or Firm*—Bachman & LaPointe

[57] ABSTRACT

Device for cleaning cans or similar containers, whereby the cans are supported in a roughly horizontal position on, for example, rods of a chain conveyor, and are conveyed along a washing line and through a rinsing zone, over rollers or deflection pulleys. The chain conveyor (6), on emerging from the rinsing zone (2), enters a drying zone (3) in which the cans (4) are conveyed in vertical position with their opening face downward.

15 Claims, 5 Drawing Sheets

DEVICE FOR CLEANING CANS

BACKGROUND OF THE INVENTION

The invention relates to a device for cleaning cans or similar container, which are supported in a roughly horizontal position on, for example, the rods of a chain conveyor and are conveyed by means of rollers or guide pulleys through a washing zone and a rinsing zone.

Industrial cleaning of cans presently generally takes place in a washing zone, the cans to be cleaned being passed through it by means of a plurality of guide rollers. In order that the washing liquor or detergent solution can penetrate the interior of the can, the can should be guided at least in the horizontal position.

Following the washing zone the cans are rinsed in various rinsing zones, through which the cans are guided by the chain conveyor via guide rollers. This obviously takes place with the cans in the horizontal position and they must be secured against washing away.

It is then standard practice to remove the cans from the chain conveyor and feed them to a special drying area. However, this is linked with the disadvantage that additional working steps are provided for removing the cans from the chain conveyor and for supplying same to the drying area. For the chain conveyor to continue through a drying area would lead to the disadvantage that the cans would retain their horizontal position and can consequently hold rinsing liquid in the interior thereof and which is not dried in the drying area. This impairs further processing of the can, such as e.g. an internal sealing.

The problem of the present invention is to develop a device of the aforementioned type, in which the cans can be guided by the same chain conveyor in a reliable manner through all the washing and rinsing baths and through a drying area, where reliable drying takes place.

SUMMARY OF THE INVENTION

According to the invention the foregoing problem is solved in that following the rinsing area the chain conveyor runs into a drying area, where the cans are guided in a vertical position with the opening pointing downwards.

As a result there is no need to memove the cans from the chain conveyor following the rinsing zone and simultaneously in the drying area most of the rinsing water immediately flows out of the can, whilst the remainder can easily be removed by the hot air present in the drying area.

To achieve the vertical positioning of the cans in the drying area, according to the invention on entering the drying area the chain conveyor loops round a feed roller with a horizontal roller shaft and is then guided in an approximately horizontal position to a toothed gear with a vertical shaft. The change from the feed roller with the horizontal roller shaft to the toothed gear with the vertical shaft leads to the chain conveyor being rotated by 90°. The rotation of the chain conveyor is accompanied by that of the rods thereon and consequently the cans are placed in the vertical position. In the case of a chain conveyor of the type used for conveying cans, the difficulty arises that the chain cannot be rotated by 90° in the case of a constant chain tension between two rollers. Rotation by force would lead to increased chain wear. Thus, it is inventively provided that both the feed roller shaft and the toothed gear shaft are driven by in each case one synchronously rotating drive gear. In addition, between the feed roller and the toothed gear the chain conveyor is to be under reduced tension maintained over the entire life of the device by the two synchronously rotating drive gears.

Preferably use is made of a mitre gear and the two gears can be interconnected by means of a cardan or gimbal-mounted gear bar or drive shaft for ensuring their synchronous running. This gimbal-mounted drive shaft always ensures synchronous running and/or reduced chain tension. As a result of the latter the chain conveyor can rotate by 90° without suffering damage.

Following the drying area it is generally necessary for the cans to be horizontally fed to a receiving means. Thus, it is inventively provided that the chain conveyor is guided at the end of the drying area by a toothed gear with a vertical shaft on a delivery roller with a horizontal roller shaft. This once again leads to a looping of the cans and once again the tension of the chain conveyor must be reduced, which can be brought about by the aforementioned gear associated with the delivery roller and the toothed gear.

It is obviously possible to assist the righting of the cans by guide rails running laterally along the chain conveyor.

Moreover, both in the washing zone and in the rinsing zone, it is necessary to prevent a washing away of the cans, particularly due to washing or rinsing bath movements. This is brought about by nozzles positioned facing the chain conveyor between two successive rollers and which subject the can bottoms to the action of a medium. Thus, the cans are not raised from the rod tips. Through the action of the medium they are kept in constant contact with the rod tips.

According to the invention the medium can be external water, air, etc. Air could e.g. have the advantage that through bubble formation in the detergent solution a certain turbulence is performed, which leads to a better washing effect for the cans. However, the turbulence could become too powerful, so that the cans could be rotated about the rods and would e.g. strike too strongly against the said rods with the opening rim. Therefore preference is given to a liquid medium. Thus, according to the invention, use is made of the detergent solution in the washing zone and the rinsing water in the rinsing zone. The nozzles are arranged on a nozzle chamber extending in the chain conveyor running direction, so that the cans are accompanied by nozzles for as long as possible during their rotation. The nozzle chamber is then connected via a delivery line with a pump for delivering the medium, in this case the detergent solution or rinsing water, the pump collecting said medium by means of a further line from the washing bath or rinsing basin.

According to the invention the chain conveyor can also be accompanied by stop bars, which prevent a washing away.

It has proved to be particularly effective to provide the corresponding rollers of the chain conveyor with stop disks in the washing or rinsing zone. The can is then guided between the toothed gear engaging in the chain links and the stop disk. Stop disks of adjacent rollers are so close to one another that the cans can be transferred from one roller to the other without any significant interruption, so that the washing away of cans is prevented.

In addition, the roller core between the stop disk and the toothed gear is to be made conical, so that the can engaging with said core on passing out of the detergent solution or rinsing water line is emptied.

It is also inventively provided that the mounting of the rollers takes place outside the washing or rinsing tanks or basins and for this purpose there are corresponding seals with respect to the individual tanks or basins.

It can be advantageous to assist the rotation of the chain conveyor by further drives. The latter can be coupled with corresponding gear elements to make their running uniform, so that the chain always retains the desired tension making it possible for the rods to be held in the horizontal position in spite of their unfavourable lever action.

BRIEF DESCRIPTION OF THE DRAWINGS

Further advantages, features and details of the invention can be gathered from the following description of preferred embodiments, as well as by means of the drawings, wherein show.

DETAILED DESCRIPTION

Figure 1:
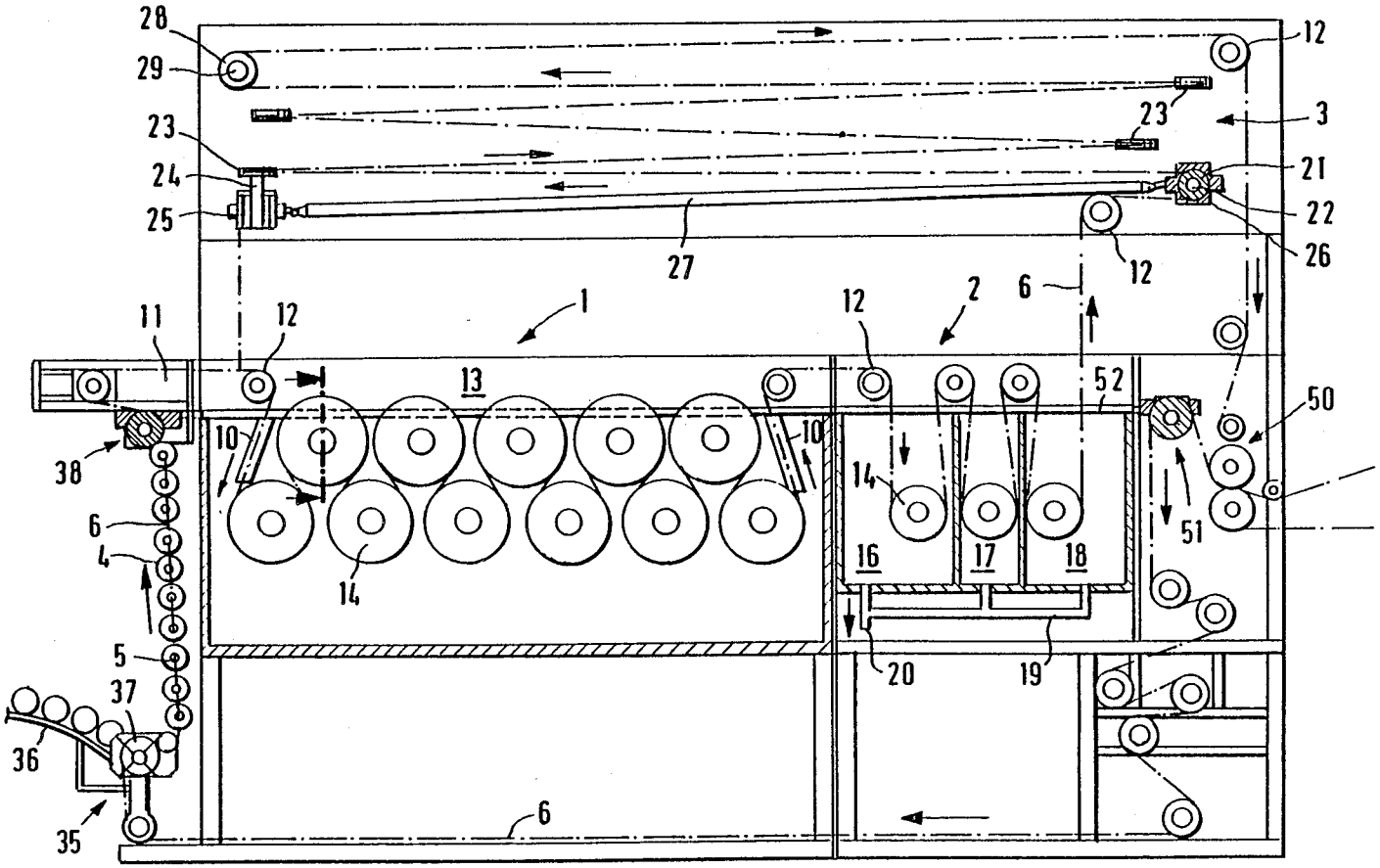
FIG. 1 a diagrammatic side view of an inventive device for cleaning cans.

An inventive device for cleaning cans, according to FIG. 1, essentially comprises a washing zone 1, a rinsing zone 2 and a drying area 3.

Cans 4, whereof only some are shown in FIG. 1 to make the drawing more readily comprehensible, pass into a transfer station 35 on rods 5 of a chain conveyor 6. The transfer can e.g. take place by means of vacuum from a conveyor belt 36 and using an intake or feed star wheel 37.

Figure 3:
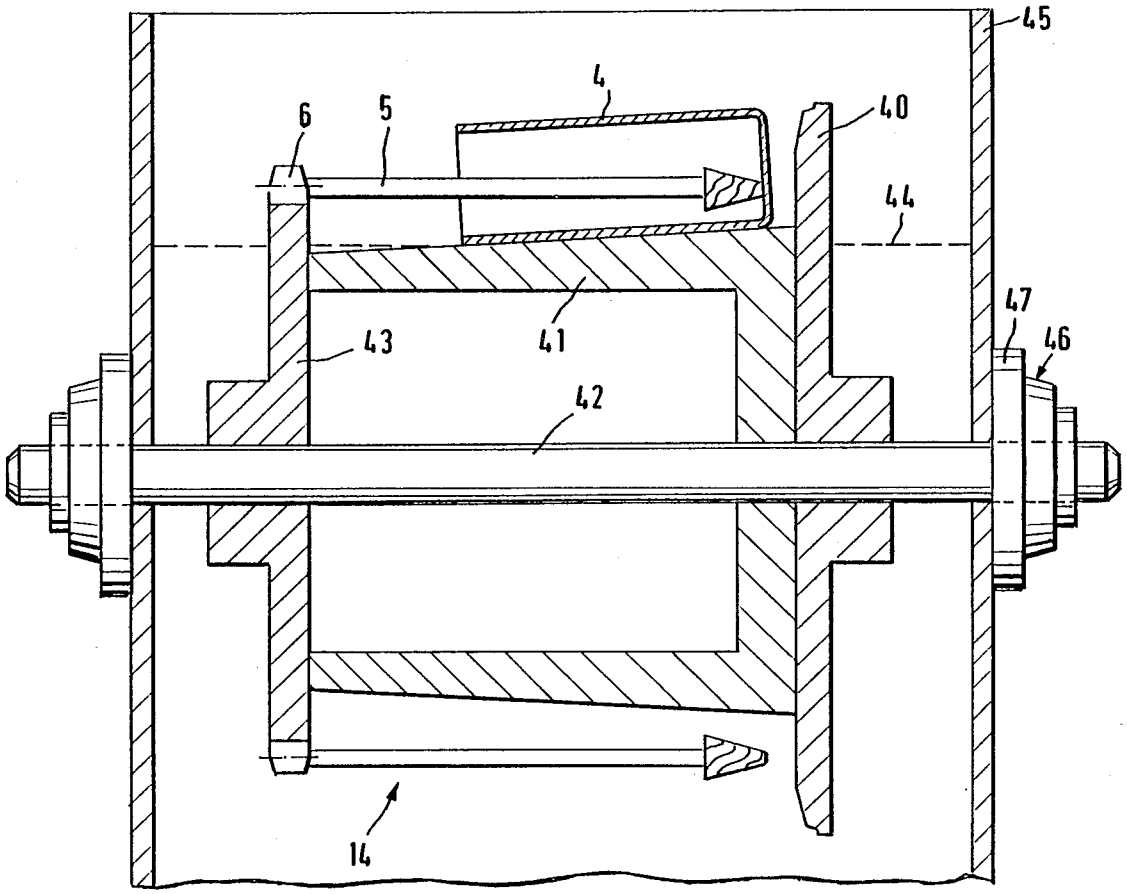
FIG. 3 a cross-section through a larger scale detail according to FIG. 1 along line III—III.

In the embodiment according to FIG. 3 the chain conveyor 6 is a simple Gall steel bushed chain formed from outer link plates 7 and inner link plates 8, which are interconnected by means of pins 9. Certain of these pins are extended at a certain distance from one another to the rods 5. In FIG. 3 can 4 floats around rod 5 and here only the position is shown in which, by chance, rod 5 also roughly forms the central axis for can 4.

Following intake 11, chain conveyor 6 is introduced by means of a guide pulley 12 into a washing bath 13 filled with a detergent solution. There is a multiple deflection of chain conveyor 6 by means of rollers 14 in washing bath 13. In the latter the detergent solution must always be kept moving, e.g. by means of a circulating pump, so that more intense washing takes place. In order to prevent washing away of the cans 4 in the case of a roughly horizontal guidance on rods 5 of chain conveyor 6, cans 4 are guided between the chain conveyor 6 and a stop bar 10. On passing round rollers 14, said guidance is taken over by the stop disk 40 (cf. FIG. 4). The stop disks 40 of adjacent rollers 14 are so constructed and arranged that they rotate at a close distance from one another. The cans 4 then slide from one stop disk 40 to the next without any significant interruption.

Otherwise a roller 14 comprises a longitudinally sectionally conical core 41 through which passes a shaft 42. On one side of core 41 is provided shaft 42 and on the other side a toothed gear 43 for chain 6. The conical construction of core 41 with tapering towards the toothed gear 43 means that when the cans 4 pass round the upper rollers 14, they emerge from the detergent solution line 44 and the solution can flow out of the cans 4. Shaft 42 is mounted outside the detergent solution container 45 and there are bearing boxes 46 with corresponding seals 47 with respect to container 45.

Figure 4:
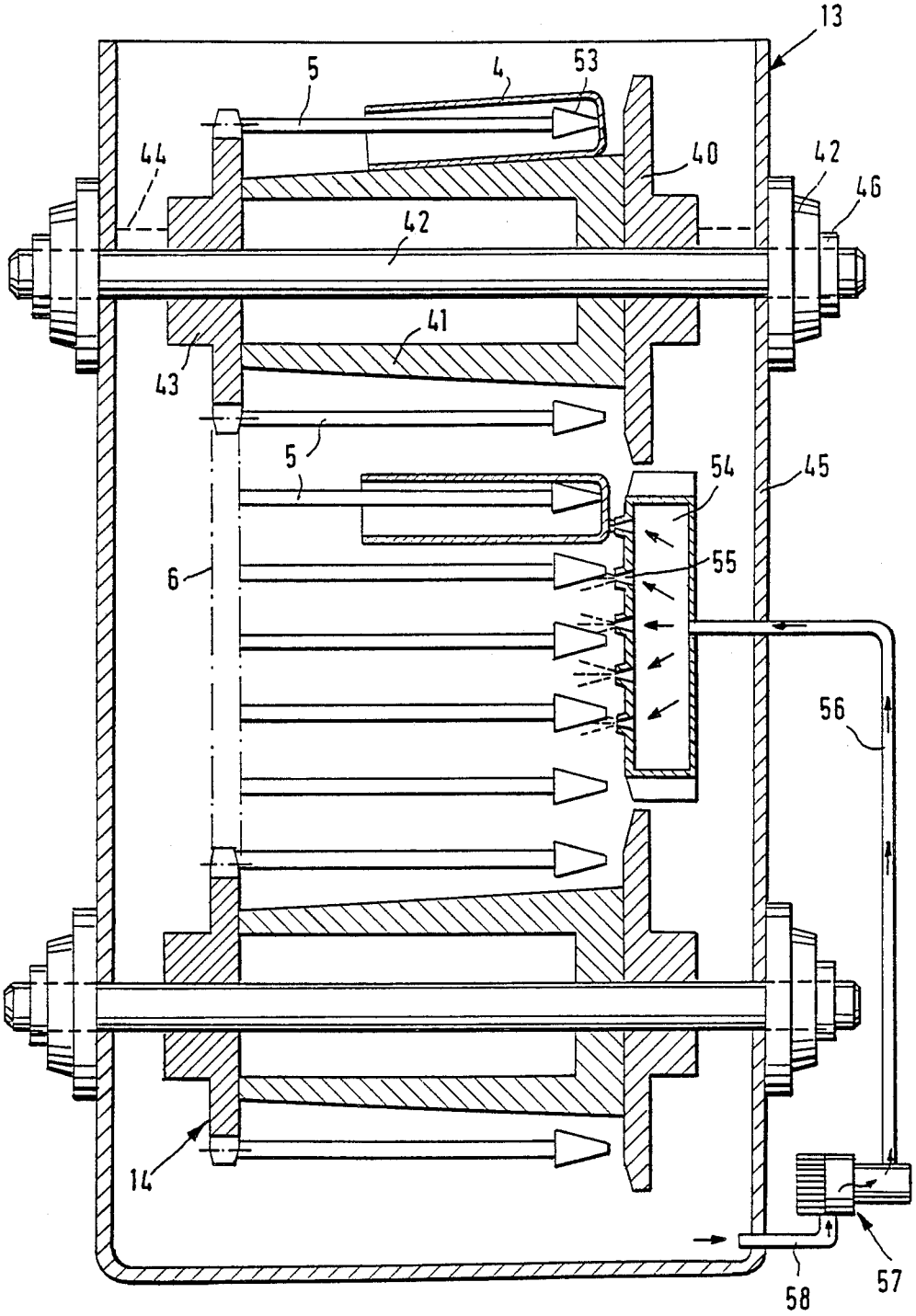
FIG. 4 a cross-section through a washing bath.

In place of the stop bars 10, according to FIG. 4 between the stop disks 40 of two adjacent rollers 14, there is a nozzle chamber 54 in the running direction of chain conveyor 6 and towards the latter is provided with nozzles 55. Nozzle chamber 54 is connected by means of a delivery line 56 to a pump 57, which collects detergent solution from washing bath 13 by means of a line 58. The washing solution passing out of the nozzles 55 in this way means that the cans are held on rods 5, so that a washing away of the cans is prevented.

From washing zone 1, chain conveyor 6 passes over further guide pulleys 12 and rollers 14 into a prerinsing basin 16, then into a main rinsing basin 17 and subsequently into an afterrinsing basin 18. In FIG. 1 in each case only one roller 14 is shown. However, there can be several rollers 14 or stop bars 10 and/or nozzle chambers 54.

In the afterrinsing basin 18 the cans are rinsed fat-free, i.e. 100% clean, e.g. using fresh spring water. According to the invention this water from the afterrinsing basin 18 is introduced at regular intervals into the main rinsing basin 17 and the water from the latter at regular intervals into the prerinsing basin 16, as is indicated by line 19. The spent water can then be fed into the sewage system by means of a drain 20.

From afterrinsing basin 18 cans 4 pass on chain conveyor 6 into drying area 3 and following a guide pulley 12 the chain conveyor 6 loops the feed roller 21 with a horizontal roller shaft 22. From feed roller 21 chain 6 is guided to a toothed gear 23, whose shaft 24 is vertical. Both shaft 24 and roller shaft 22 issue into a drive gear 25 or 26, both of the latter being interconnected by means of a cardan or gimbal-suspended gear bar 27. Generally mitre gears are used.

Figure 1A:
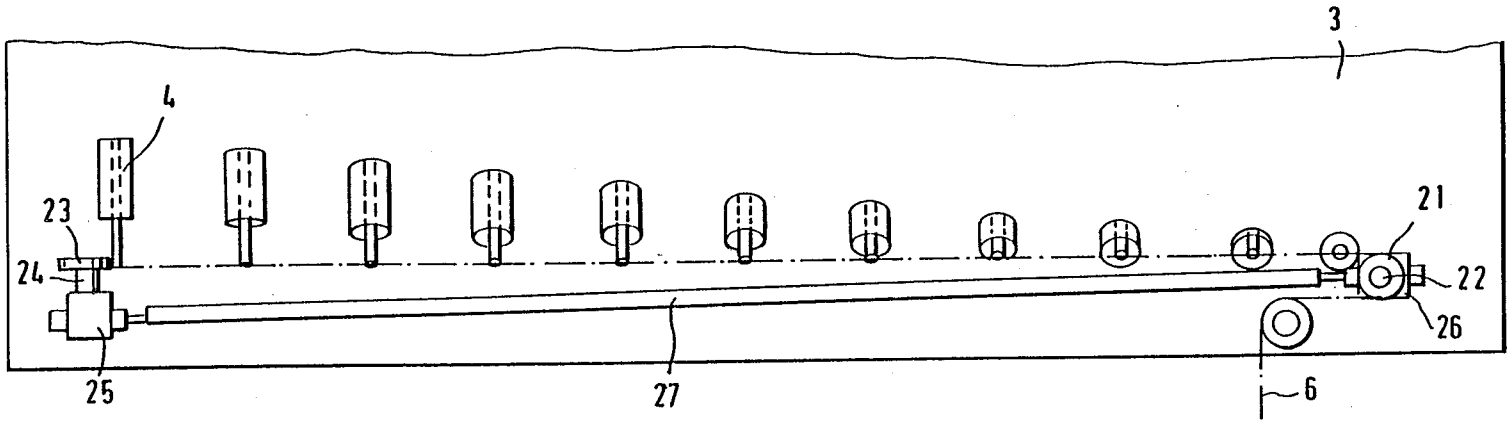
FIG. 1*a* a diagrammatic view of part of the device according to FIG. 1.
Figure 2:
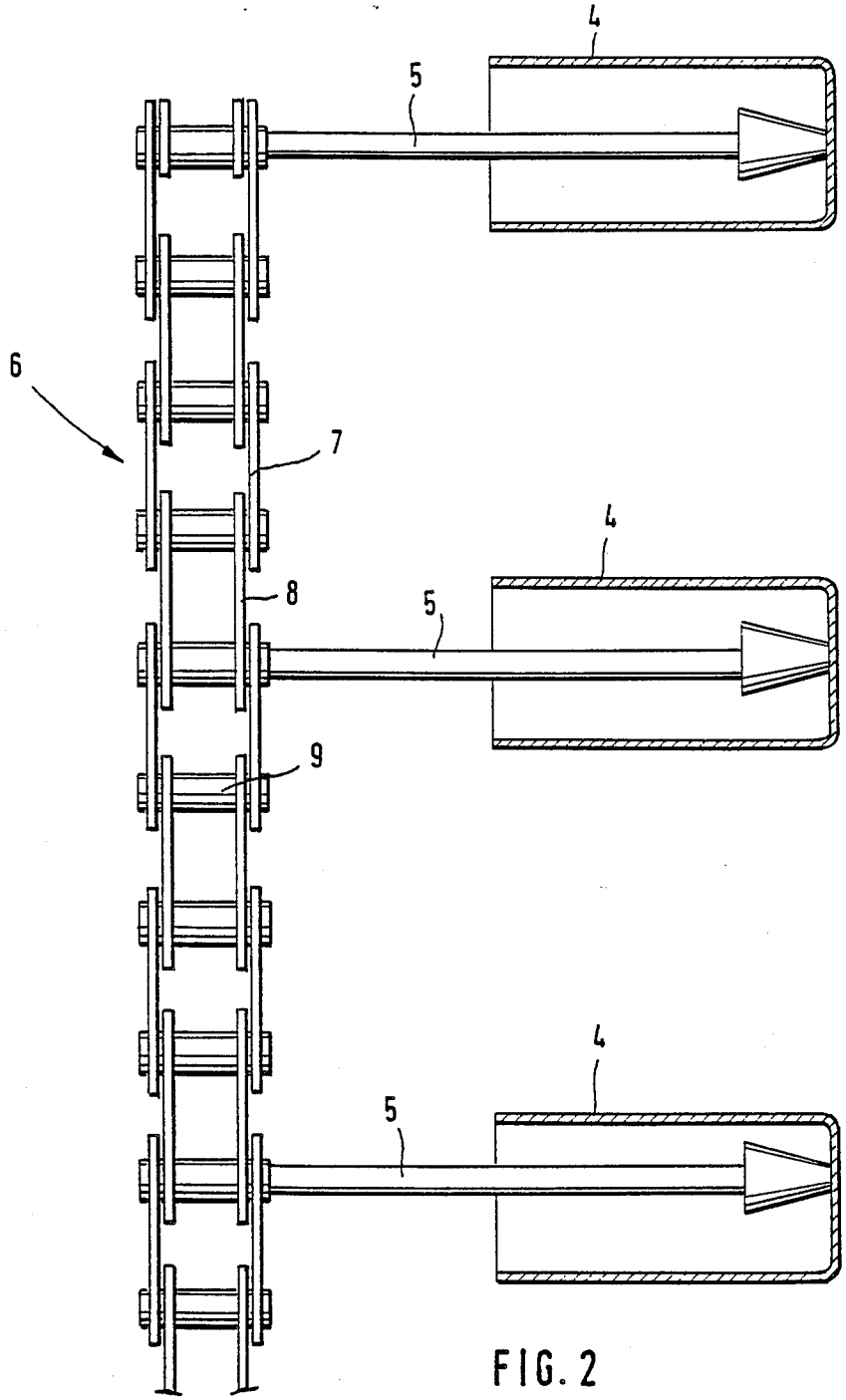
FIG. 2 a larger scale, partly broken away side view of a detail of FIG. 1.

The connection between gears 25 and 26 takes place in such a way that a large part of the tension of chain conveyor 6 is removed between the feed roller 21 and the toothed gear 23. This makes it possible for the chain conveyor 6 to complete a 90° rotation between feed roller 21 and toothed gear 23. As shown in FIG. 1a, this 90° rotation is also followed by rods 5 and together with the latter the cans 4, which are consequently positioned upright. In this position the cans can drip of their own accord and are also subject to hot air action.

Following the multiple deflection of the chain conveyor 6 by means of toothed gears 23 shown in FIG. 1, chain conveyor 6 passes onto a delivery roller 28 with a horizontal shaft 29. For reasons of simplicity, the shaft of the toothed gear 23 upstream of delivery roller 28 and the shaft of the latter can also be coupled in cardan-mounted manner with drive gears 25 and/or 26. This also allows a 90° rotation of chain conveyor 6, which is accompanied by rods 5 and with same cans 4. Thus, cans 4 are again horizontally positioned and pass via guide pulleys 12 to a receiving means 50.

After receiving means 50, the chain conveyor 6 is guided back to the transfer station 35 by means of a further drive 51. The latter has a preferably cardan coupling 52 with drive 38. All the drives can be individually or jointly interconnected by means of corresponding gear elements.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

I claim:

1. A device for cleaning containers having a base and an open top connected by sidewall means which together with said base defines an internal cavity having a longitudinal axis, the improvement comprising: a wash zone, a rinse zone and a dry zone; a continuous conveyor means for transporting said containers to said wash zone, from said wash zone to said rinse zone and from said rinse zone to said dry zone, said conveyor means includes means for penetrating the internal cavity of the containers for holding said containers on said conveyor means; and drive means for driving said conveyor such that said containers pass through said wash zone and said rinse zone with said longitudinal axis located in a substantially horizontal plane wherein the cavity, sidewall means and base are cleaned and rinsed and said containers pass through said dry zone with said longitudinal axis located in a substantial vertical plane wherein said open top is directed downwards so as to allow fluid to drip from the internal cavity of the containers wherein the conveyor means loops round a feed roller with a horizontal roller shaft and is then guided approximately horizontally to a toothed gear with a vertical shaft upon entering the dry zone.

2. A device according to claim 1 wherein in each case one synchronously moving gear is associated with the roller shaft and the vertical shaft.

3. A device according to claim 2 wherein the gears are mitre gears.

4. A device according to claim 2 wherein the gears are interconnected by means of a cardan-mounted gear bar.

5. A device according to claim 1 wherein the chain conveyor means at the end of the dry zone is guided by a toothed gear with a vertical shaft on a delivery roller with horizontal roller shaft, so that the containers run in an approximately horizontal position to an outlet.

6. A device according to claim 1 wherein in the vicinity of the dry zone the conveyor means is surrounded by lateral guide rails, which right the cans.

7. A device according to claim 1 wherein nozzle means are positioned facing the conveyor means for subjecting the can bottoms to the action of a cleaning medium in said washing zone.

8. A device according to claim 7 wherein the nozzle means issue from a nozzle chamber extending in the running direction of the conveyor means.

9. A device according to claim 8 wherein the nozzle chamber is connected by means of a delivery line to a pump for delivering the cleaning medium.

10. A device according to claim 9 wherein the pump by means of a line in the washing zone removes detergent solution and/or in the rinsing zone rinsing water from the corresponding washing bath or rinsing basin.

11. A device according to claim 1 wherein in the vicinity of the wash zone and the rinse zone, the cans are guided between the conveyor means and a stop.

12. A device according to claim 11 wherein the stop is constructed as a stop bar at a certain distance from the conveyor means.

13. A device according to claim 1 wherein rollers are provided with stop disks for guiding said conveyor means.

14. A device according to claim 13 wherein the rollers have a conical axially directed core.

15. A device according to claim 14 wherein the rollers are mounted in sealed bearing boxes outside the wash zone and the rinse zone.

* * * * *